US006374946B1

(12) United States Patent
Petzl et al.

(10) Patent No.: US 6,374,946 B1
(45) Date of Patent: Apr. 23, 2002

(54) ROPING HARNESS WITH AN OFFSET ATTACHMENT STRIP

(75) Inventors: Paul Petzl, Barraux; Jean Marc Hede, Le Touvet, both of (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/597,091

(22) Filed: Jun. 20, 2000

(30) Foreign Application Priority Data

Jul. 16, 1999 (FR) ..... 99 09412

(51) Int. Cl.[7] ..... A47L 3/04
(52) U.S. Cl. ..... 182/6; 182/3; 182/7; 244/151 R
(58) Field of Search ..... 182/3, 4, 5, 6, 182/7, 192; 244/151 R, 259

(56) References Cited

U.S. PATENT DOCUMENTS

| | | | | | |
|---|---|---|---|---|---|
| 3,444,957 | A | * | 5/1969 | Ervin, Jr. | 182/3 |
| 4,479,624 | A | * | 10/1984 | Martin et al. | 244/152 |
| 5,090,503 | A | * | 2/1992 | Bell | 182/5 |
| 5,174,410 | A | * | 12/1992 | Casebolt | 182/3 |
| 5,228,412 | A | | 7/1993 | Bell | |
| 5,433,289 | A | | 7/1995 | O'Rourke | |
| 5,569,057 | A | * | 10/1996 | Barsdorf et al. | 441/65 |
| 5,598,900 | A | * | 2/1997 | O'Rourke | 182/3 |
| 5,664,844 | A | * | 9/1997 | Greene | 297/485 |
| 5,878,833 | A | * | 3/1999 | Bell | 182/3 |
| 5,960,480 | A | * | 10/1999 | Neustater et al. | 182/3 X |
| 6,006,700 | A | * | 12/1999 | Cox | 182/3 X |
| 6,006,860 | A | * | 12/1999 | Bell | 182/3 X |
| 6,032,758 | A | * | 3/2000 | May | 182/3 |
| 6,125,966 | A | * | 10/2000 | Jones | 182/3 |
| 6,158,548 | A | * | 12/2000 | May | 182/3 |

FOREIGN PATENT DOCUMENTS

| | | | | |
|---|---|---|---|---|
| EP | 0 508 278 A1 | | 3/1992 | |
| GB | 3066346 | * | 7/1981 | 182/3 |
| WO | WO 98/40124 | | 9/1998 | |

* cited by examiner

*Primary Examiner*—Bruce A. Lev
(74) *Attorney, Agent, or Firm*—Oliff & Berridge, PLC

(57) ABSTRACT

A roping harness comprises a sit harness, a pair of shoulder straps fixed to the front and rear of the belt, and an offset attachment strip formed by an auxiliary extension strap. The attachment strip has a first fixing end securedly affixed to the front of the harness, and a second attachment end located at the rear of the harness, said strip being superposed on one of the shoulder straps by a detachable retaining part able to be in a secured contact position or in a released position depending on whether the tensile force exerted on the attachment strip is lower than or greater than a preset threshold, movement from the secured contact position to the released position taking place following a fall or by a manual operation causing separation of the second end of the shoulder strap and transfer movement of the attachment strip to the front.

7 Claims, 5 Drawing Sheets

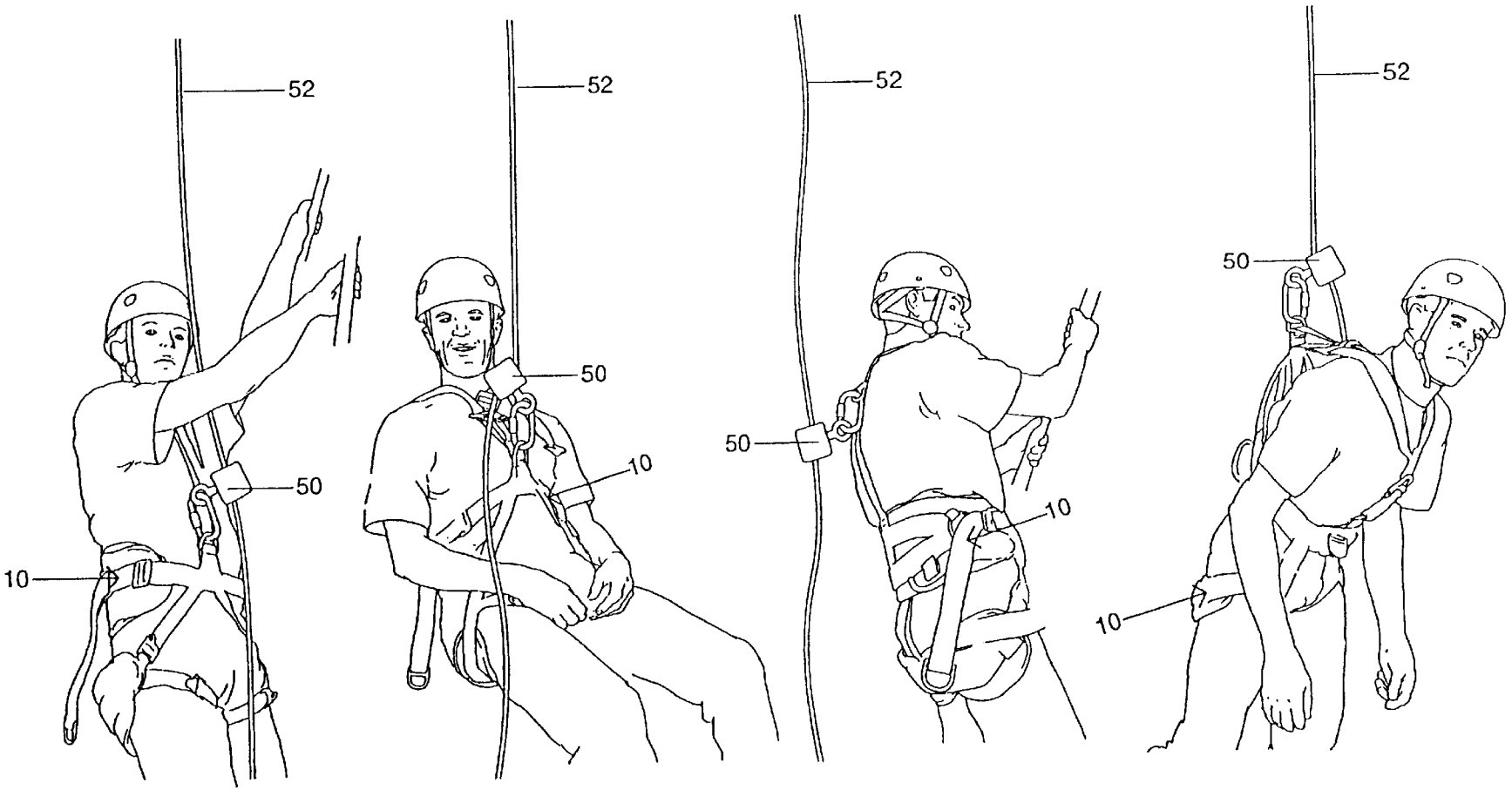
PRIOR ART FIG 4
PRIOR ART FIG 3
PRIOR ART FIG 2
PRIOR ART FIG 1

ROPING HARNESS WITH AN OFFSET ATTACHMENT STRIP

BACKGROUND OF THE INVENTION

The invention relates to a roping harness comprising:

a sit harness comprising a securing belt and a pair of leg loops joined to the belt by joining straps, a pair of shoulder straps fixed to the front and rear of the belt, each shoulder strap comprising a chest strap extended by a dorsal strap forming a half-turn designed to pass over the user's shoulder, and an offset attachment strip formed by an auxiliary extension strap.

STATE OF THE TECHNIQUE

Known harnesses generally have two attachment points to be secured to the safety rope by means of an attachment strip and a follower jammer. The first type of belaying on a front abdominal or chest attachment point is illustrated in FIGS. 1 and 2. The follower jammer 50 is secured to the front attachment point, with the drawback of the permanent presence of the rope 52 in front of the user, which hinders his progression and work (FIG. 1). In the event of a fall on the other hand, the user is secured to the rope 52 in total safety with optimum comfort, and the rope 52 is easily accessible thus enabling the user to draw himself back up (FIG. 2).

The second type of belaying on a dorsal rear point is represented in FIGS. 3 and 4. The follower jammer 50 is secured to the rear attachment point with the advantage that the rope 52 is at the back without hindering the user's progression or work (FIG. 3). In the event of a fall however, the user finds himself in an uncomfortable position hanging suspended by his back with the rope 52 rendered inaccessible behind him (FIG. 4). Any attempt to right his position on the rope by himself is then impossible.

An anti-fall harness PR7 manufactured by Protecta International exists which makes use of an extension strap attached to a dorsal attachment point and then run over the shoulder to the front. In the event of stopping due to a fall, the user again finds himself in the uncomfortable situation of FIG. 4.

OBJECT OF THE INVENTION

The object of the invention is to achieve a reliable roping harness which combines all the advantages of known solutions without the drawbacks thereof, i.e. in which the user is not hampered by the rope in normal use and is stopped in the event of a fall with optimum comfort while preserving the accessibility to the rope to be able to perform self-rescue.

The harness according to the invention is characterized in that the attachment strip has a first fixing end securedly affixed to the front of the harness, and a second attachment end located at the rear of the harness, said strip being superposed on one of the shoulder straps by means of a detachable retaining part able to be in a secured contact position or in a released position depending on whether the tensile force exerted on the attachment strip is lower than or greater than a preset threshold, movement from the secured contact position to the released position taking place following a fall or by a manual operation causing separation of the second end of the shoulder strap and transfer movement of the attachment strip to the front.

According to a preferred embodiment, the retaining part of the attachment strip is located in the secured contact position on the dorsal strap of the shoulder strap. The first fixing end of the attachment strip is located on a common part for assembly of the chest straps of the two shoulder straps to the belt.

The detachable retaining part can be formed either by at least one strip of self-gripping securing tape, or by a securing system by means of snap-fastener buttons, or elastic securing means.

BRIEF DESCRIPTION OF THE DRAWINGS

Other advantages and features of the invention will become more clearly apparent from the following description of an embodiment of the invention given as a non-restrictive example only and represented in the accompanying drawings, in which:

FIGS. 1 and 2 are schematic views of a known harness of the prior art with an abdominal or chest attachment point, respectively before and after a fall;

FIGS. 3 and 4 are schematic view of a known harness of the prior art with a dorsal rear attachment point, respectively before and after a fall;

DESCRIPTION OF THE PREFERRED EMBODIMENT

Figure 5:
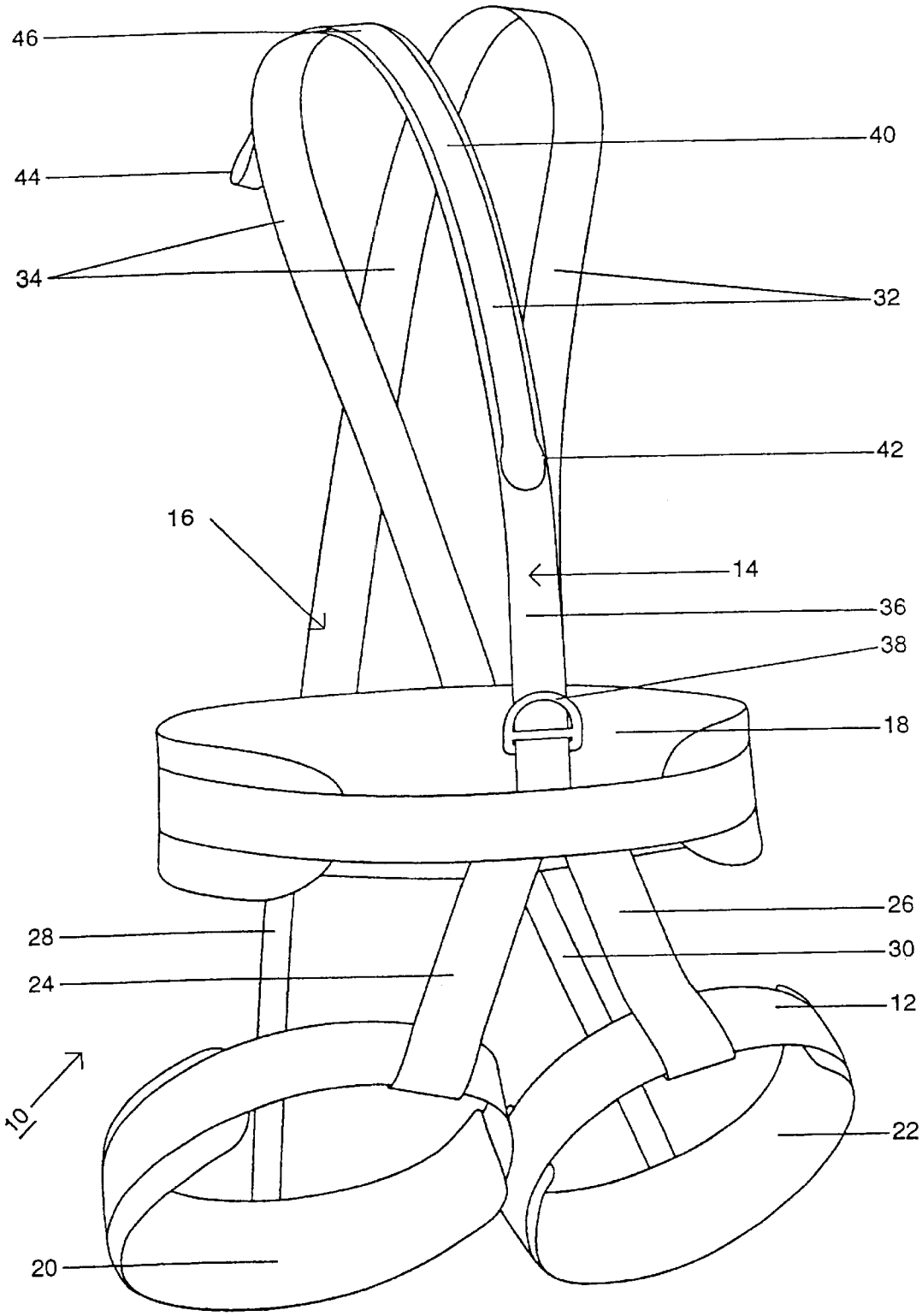
FIG. 5 shows a perspective view of a harness equipped with an attachment strip according to the invention.
Figure 6:
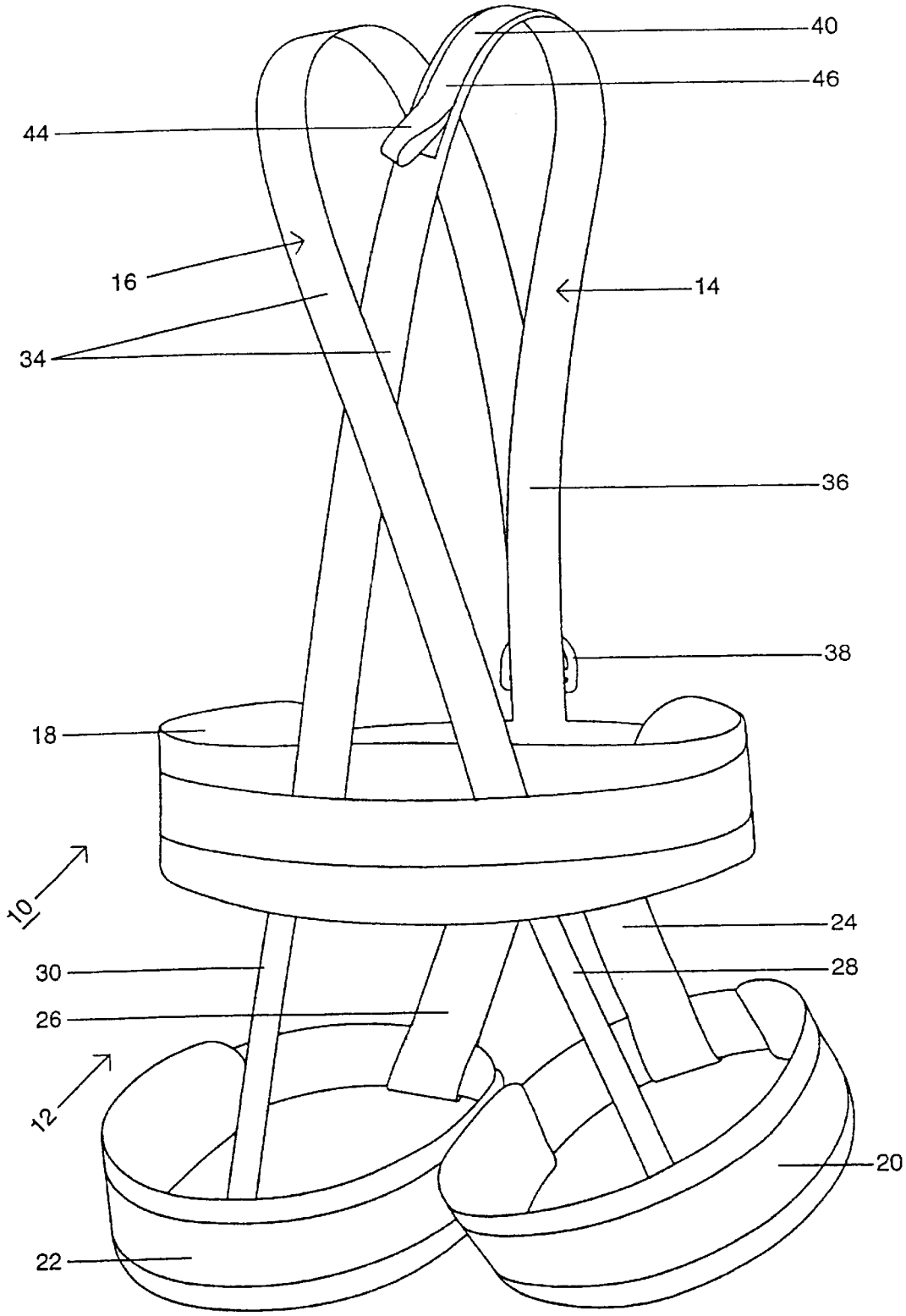
FIG. 6 represents the harness of FIG. 5 seen from behind, the attachment strip being in the engaged contact position with one of the shoulder straps.

In FIGS. 5 and 6, a roping harness 10 comprises a sit harness 12 associated to a pair of cross-over shoulder straps 14, 16. The sit harness 12 comprises a securing belt 18 designed to fit round the user's waist and a pair of leg loops 20, 22 joined to the front of the belt 18 by first joining straps 24, 26, and to the rear of the belt 18 by second elastic positioning straps 28, 30.

Each shoulder strap 14, 16 comprises a chest strap 32 extended by a dorsal strap 34 forming a half-turn passing over the user's shoulder. The two chest straps 32 of the shoulder straps 14, 16 are joined to a common part 36 fixed to the front of the belt 18, whereas the two ends of the dorsal straps 34 are sewn onto the back of the belt 18. An attachment ring 38 fitted on the common part 36 of the shoulder straps 14, 16 is secured to the belt 18.

The harness 10 is in addition equipped with an offset attachment strip 40 which is formed by an auxiliary extension strap having a first end 42 fixed onto the front of the harness 10 near to the common part 36, and a second end 44 located at the rear of the harness 10. The attachment strip 40 is superposed on one of the shoulder straps 14, and the second end 44 is held in engagement against the dorsal strap 34 by a retaining part 46.

The second end 44 is in the shape of a ring designed to be attached to a jammer by means of a snap-hook. The retaining part 46 occupies a secured contact position when the jammer slides normally along the belaying rope. The force applied to the attachment strip 40 during normal progression is insufficient to release the retaining part 46. Release of the retaining part 46 takes place when the user falls, due to the fact that the tensile force exerted on the attachment strip 40 exceeds a preset threshold. In this case, the retaining part 46 blows like a fuse and releases, and the user finds himself attached to the rope by the first front end 42 fixed onto the front of the harness 10.

The detachable retaining part 46 can be achieved in different ways, for example by means of a strip of self-gripping securing taps commercially called VELCRO® (registered trademark), by a securing system by means of snap-fastener buttons 46B, or elastic securing means 46E. The retaining part 46 is preferably arranged located at the beginning of the dorsal strap 34 near to the back of the user's shoulder. securing means. The retaining part 46 is preferably arranged located at the beginning of the dorsal strap 34 near to the back of the user's shoulder.

Figure 9:
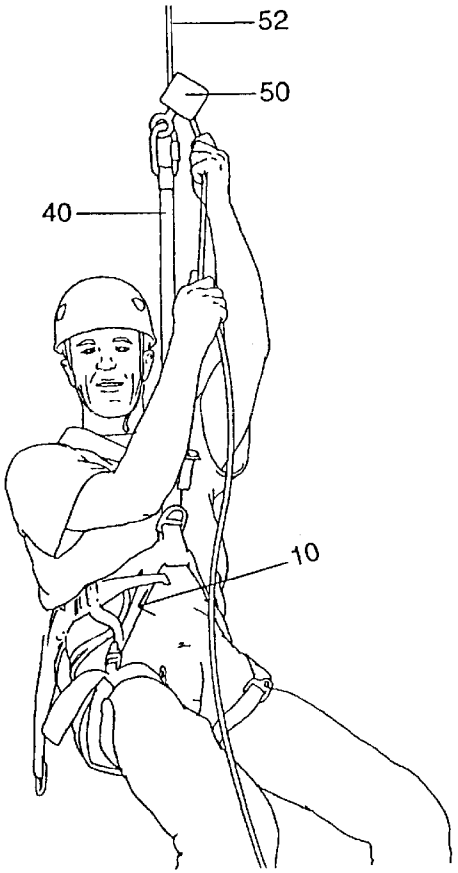
FIGS. 7 to 9 show the different phases of operation of the harness of FIG. 5, respectively before and after a fall, and when performing self-rescue by climbing back up the rope.
Figure 8:
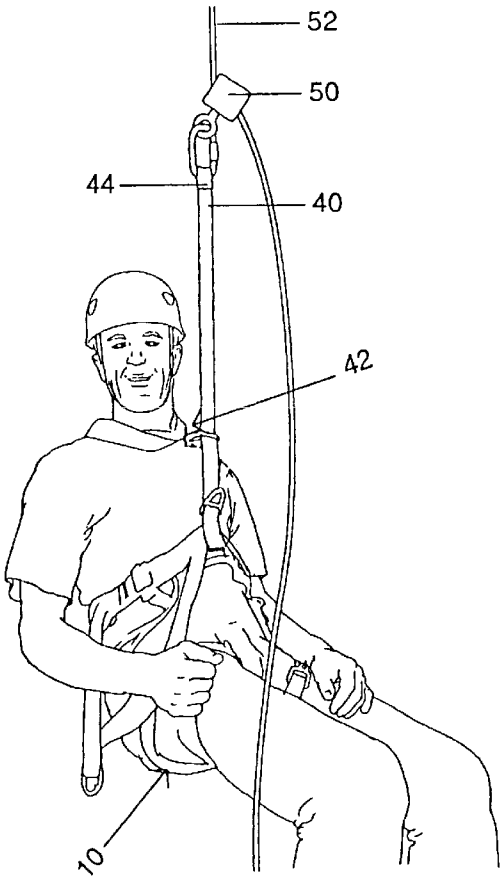
Figure 7:
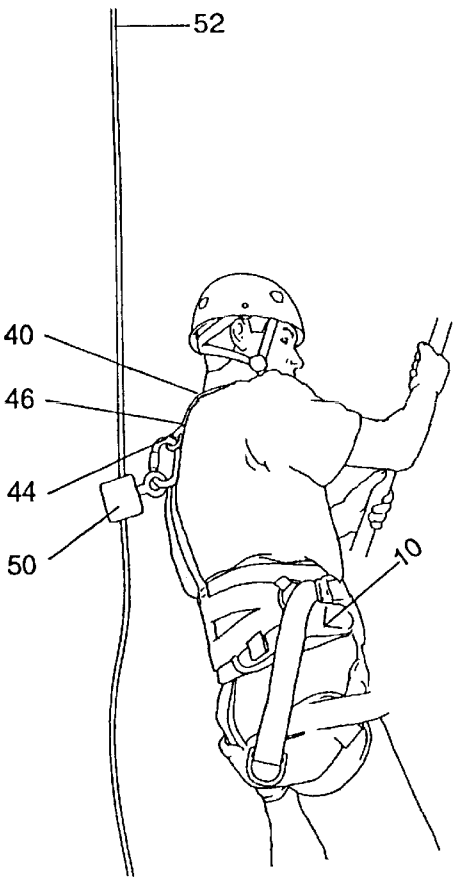
Figure 10:
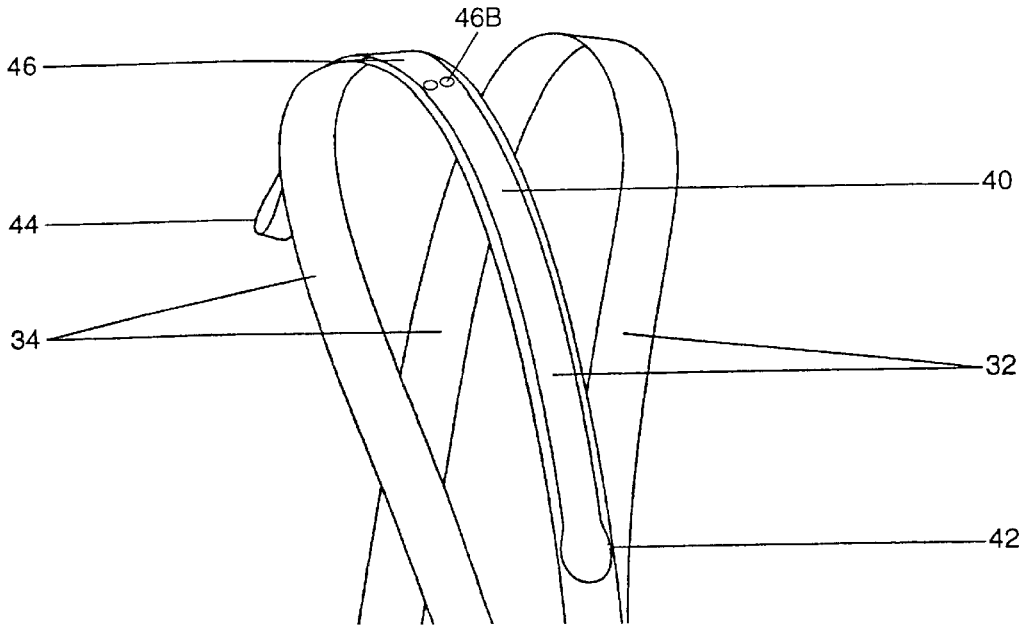
FIG. 10 shows a perspective view of a portion of the harness of FIG. 5 with snap fastener buttons.
Figure 11:
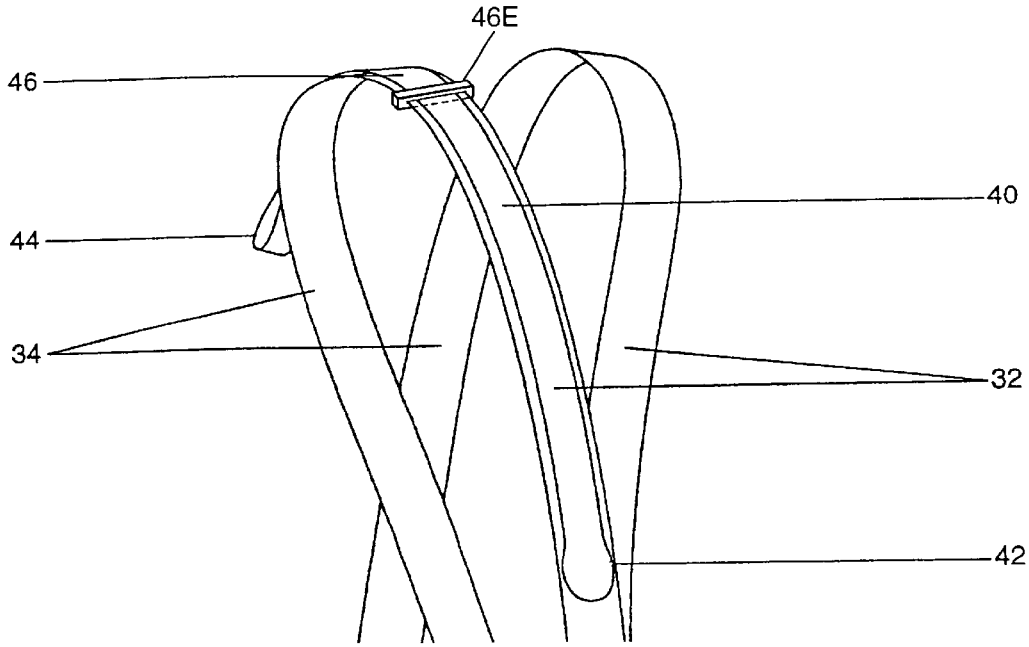
FIG. 11 shows a perspective view of a portion of the harness of FIG. 5 with an elastic securing means.

Operation of the harness 10 equipped with the offset attachment strip 40 according to the invention is represented in FIGS. 7 to 9.

In FIG. 7, the retaining part 46 of the attachment strip 40 is in the secured contact position with the dorsal strap 34, and the second end 44 is kept with its jammer 50 behind the user's back. The rope 52 is permanently behind the user and does not hinder his progression in normal use.

In FIG. 8, the detachable retaining part 46 has released following a fall, and the jammer 50 automatically stops the downward movement of the user with the rope 52 moving to the front. The user is then comfortably attached to the rope 52 via the first front end 42 of the attachment strip 40.

In FIG. 9, the rope 52 is easily accessible and the user can move upwards and downwards along the rope 52 which is then accessible with the usual techniques of progression on a rope.

The retaining part 46 can be easily detached manually for ease of fitting of the jammer 50.

The roping harness 10 with offset attachment strip 40 can be used for self-belaying when mountaineering or for working at heights.

What is claimed is:

1. A roping harness, comprising:

a sit harness comprising a securing belt and a pair of leg loops joined to the belt by joining straps;

a pair of shoulder straps fixed to the front and rear of the belt, each shoulder strap comprising a chest strap extended by a dorsal strap forming a half-turn designed to pass over the user's shoulder; and an offset attachment strip formed by an auxiliary extension strap; wherein the attachment strip has a first fixing end securedly affixed to the front of the harness, and a second attachment end located at the rear of the harness, the attachment strip being superposed on one of the shoulder straps by a detachable retaining part able to be in a secured contact position or in a released position depending on whether the tensile force exerted on the attachment strip is lower than or greater than a preset threshold, movement from the secured contact position to the released position taking place following a fall or by manual operation causing separation of the second end of the shoulder strap and transfer movement of the attachment strip to the front.

2. The roping harness according to claim 1, wherein the retaining part of the attachment strip is located in the secured contact position on the dorsal strap of the shoulder strap.

3. The roping harness according to claim 2, wherein the retaining part is arranged located at the beginning of the dorsal strap near to the user's shoulder.

4. The roping harness of claim 1, wherein the first fixing end of the attachment strip is located on a common part of the shoulder straps for assembly of the chest straps of the two shoulder straps to the belt.

5. The roping harness according to claim 1, wherein the retaining part is formed by at least one strip of self-gripping securing tape.

6. The roping harness of claim 1, wherein the retaining part is formed by a securing system comprising snap-fastener buttons.

7. The roping harness according to claim 1, wherein the retaining part is formed by elastic securing means.

* * * * *